United States Patent [19]

Vollbrecht

[11] Patent Number: 4,720,638

[45] Date of Patent: Jan. 19, 1988

[54] ELECTRONICALLY COMMUTATED COAXIAL STARTER MOTOR/ALTERNATOR FOR AN INTERNAL COMBUSTION ENGINE

[75] Inventor: Kenneth A. Vollbrecht, Milwaukee, Wis.

[73] Assignee: Briggs & Stratton Corporation, Wauwatosa, Wis.

[21] Appl. No.: 891,167

[22] Filed: Jul. 31, 1986

[51] Int. Cl.[4] ..... F02N 11/08

[52] U.S. Cl. ..... 290/38 R; 290/48

[58] Field of Search ..... 290/10, 22, 31, 38 R, 290/46, 48

[56] References Cited

U.S. PATENT DOCUMENTS

| | | | |
|---|---|---|---|
| 3,591,844 | 7/1971 | Schonebeck et al. | 290/31 |
| 3,908,130 | 9/1975 | Lafuze | 290/31 X |
| 4,219,739 | 8/1980 | Greenwell | 290/46 |
| 4,401,938 | 8/1983 | Cronin | 290/38 R X |
| 4,459,536 | 7/1984 | Wirtz | 290/46 X |

FOREIGN PATENT DOCUMENTS

| | | | |
|---|---|---|---|
| 2078451 | 1/1982 | United Kingdom | 290/22 |

*Primary Examiner*—Charles D. Miller
*Assistant Examiner*—W. E. Duncanson, Jr.
*Attorney, Agent, or Firm*—Andrus, Sceales, Starke & Sawall

[57] ABSTRACT

An electronically commutated coaxial starter motor for use with internal combustion engines of the type including those utilized with lawn mowers, pumps, generators, automobiles and the like. The motor includes a stator mounted on the cylinder or block coaxially with the engine crankshaft together with angularly spaced field windings surrounding the stator, a ring magnet mounted to rotate with the crankshaft composed of a plurality of circumferentially arranged permanent magnets having alternating north-south poles, sensors in the form of magnetically actuated Hall effect devices mounted on a disc affixed to the stator for sensing the angular position of alternate ones of the poles of the ring magnet, a flywheel or other suitable rotatable member coaxially mounted to rotate with the crankshaft having a plurality of circumferentially spaced permanent magnets mounted therein, and circuitry responsive to electrical signals from the Hall effect devices for controlling current flow through the field windings to cause the flywheel or other rotatable member to rotate. Upon engine start-up, the flywheel or other rotatable member with the plurality of cirumferentially arranged permanent magnets is driven by the internal combustion engine and is automatically converted to an alternator. The conversion to direct current occurs in the incipient diodes internal to switching devices such as mosfets or in flyback diodes connected across other suitable power switching devices in the circuitry. This available power is used for battery charging and other system power requirements.

14 Claims, 5 Drawing Figures

ELECTRONICALLY COMMUTATED COAXIAL STARTER MOTOR/ALTERNATOR FOR AN INTERNAL COMBUSTION ENGINE

BACKGROUND OF THE INVENTION

The present invention relates to starter motors and more particularly to an electrically commutated coaxial starter motor for use with internal combustion engines.

Internal combustion engines of the type typically used for powering lawn mowers, pumps, generators, outboard motors, automotive engines and the like have conventionally utilized electric starter motors having gearing for driving the flywheel when starting the engine. A disengaging mechanism is also typically utilized to disconnect the starter motor from the engine after engine start up. Such engines also typically utilize alternators separate from the starter motor. A friction brake which engages the flywheel or a combination brake-clutch for a rotating blade is provided for safety purposes in lawn and garden or construction applications. It is thus desirable to provide a solid state device that provides a combination electric starter motor and alternator for automotive applications and a brake for lawn and garden applications employing internal combustion engines that eliminates the conventional gearing, separate alternator and brake.

It is known in brushless direct current motors to include a permanent magnet rotor, at least a pair of angularly spaced field windings surrounding or adjacent to the rotor, and means for controlling the commutation of current through the field windings in such a way that a rotating magnetic field is created to induce torque into the rotor and to cause it to rotate. In fact, various techniques have been employed to sense the angular position of the rotor with respect to the field windings. These techniques include employing the use of inductors, photoelectric devices, and magnetic sensors of the type shown in the following U.S. Patents:

| U.S. Pat. No. | Inventor | Issue Date |
|---|---|---|
| 2,705,770 | Suhr | April 5, 1955 |
| 3,375,422 | Boudigues | March 26, 1968 |
| 3,453,514 | Rakes et al | July 1, 1969 |
| 3,531,702 | Hill | Sept. 29, 1970 |
| 3,667,018 | Rakes | May 30, 1972 |
| 3,714,532 | McCurry | Jan. 30, 1973 |
| 3,900,780 | Tanikoshi | Aug. 19, 1975 |
| 4,455,514 | Ohno | June 19, 1984 |
| 4,460,856 | Mizumoto | July 17, 1984 |
| 4,472,665 | Tanikoshi | Sept. 18, 1984 |
| 4,475,068 | Brailsford | Oct. 2, 1984 |

SUMMARY OF THE INVENTION

An electronically commutated coaxial starter motor-/alternator for internal combustion engines that does not require either gearing for driving the flywheel of the engine or in some applications a belt to drive the alternator. The electronics of the device also provide an alternator and brake for the engine which eliminates the conventional separate alternator and brake typically employed on present state of the art lawn and garden devices. Additionally, the circuitry allows for electronic speed governing, fuel injection control, direct fire ignition, improved high end engine torque, tachometer output for spark adjusting control, and power for electric fuel and oil pumps.

In order to accomplish the above, the present invention includes a stator mounted on the engine cylinder coaxially with the crankshaft that includes a ferromagnetic core material that contains a plurality of angularly spaced current carrying field windings surrounding the stator and connected in a multi-phase configuration. Also included is a permanent magnet rotor desireably integral with the flywheel of the engine mounted to rotate with the crankshaft. The flywheel includes a plurality of circumferentially spaced permanent magnets mounted thereon with adjacent magnetic poles having opposite magnetic polarity.

It is clear to those skilled in the art that the described arrangement could also be located on the power take off (PTO) side of the engine.

Electronic commutation of the current through the field windings is accomplished by use of position indicating means coaxially mounted to rotate with the crankshaft, stationary sensing means mounted to sense the angular position of the position indicating means and generate electrical signals in response thereto, and circuit means responsive to the electrical signals from the sensing means for controlling current flow through the field windings to cause the flywheel to rotate. The position indicating means preferably comprises a non-magnetic spacer affixed to the crankshaft and a ring member surrounding the spacer composed of a plurality of circumferentially arranged permanent magnets having alternate north-south poles. The stationary sensing means comprises a plurality of magnetically actuated Hall effect devices spaced from each other and disposed radially about the axis of rotation to be actuated by magnetic flux from alternative ones of the poles of the ring member. The Hall effect devices are preferably mounted on a disc member which in turn is affixed to the stator.

The circuitry includes an oscillator which determines the switching frequency to provide duty cycle modulation of the windings to control the speed of the motor. Commutation is provided by an integrated circuit which accepts the oscillator's output and determines the crankshaft position by reading the outputs of the Hall effect devices, decodes these signals and provides appropriate logic input to power electronics which in turn energizes the proper windings in the appropriate sequence on the stator to provide torque to maintain flywheel rotation. The power electronics (usually two per motor phase) preferably comprise mosfets i.e. metal oxide silicon field effect transistors, or alternately may be darlington configured bi-polar transistors or any other suitable power switching devices connected to the stator windings.

The present invention thus provides an electronically commutated coaxial starter motor which advantageously permits the configuration of a conventional internal combustion engine to remain the same, and yet eliminates the conventional geared starter motor, alternator and friction brake on the flywheel that is used in lawn and garden applications.

BRIEF DESCRIPTION OF THE DRAWINGS

The drawings illustrate the best mode presently contemplated of carrying out the invention.

In the drawings.

DESCRIPTION OF THE PREFERRED EMBODIMENT

Figure 1:
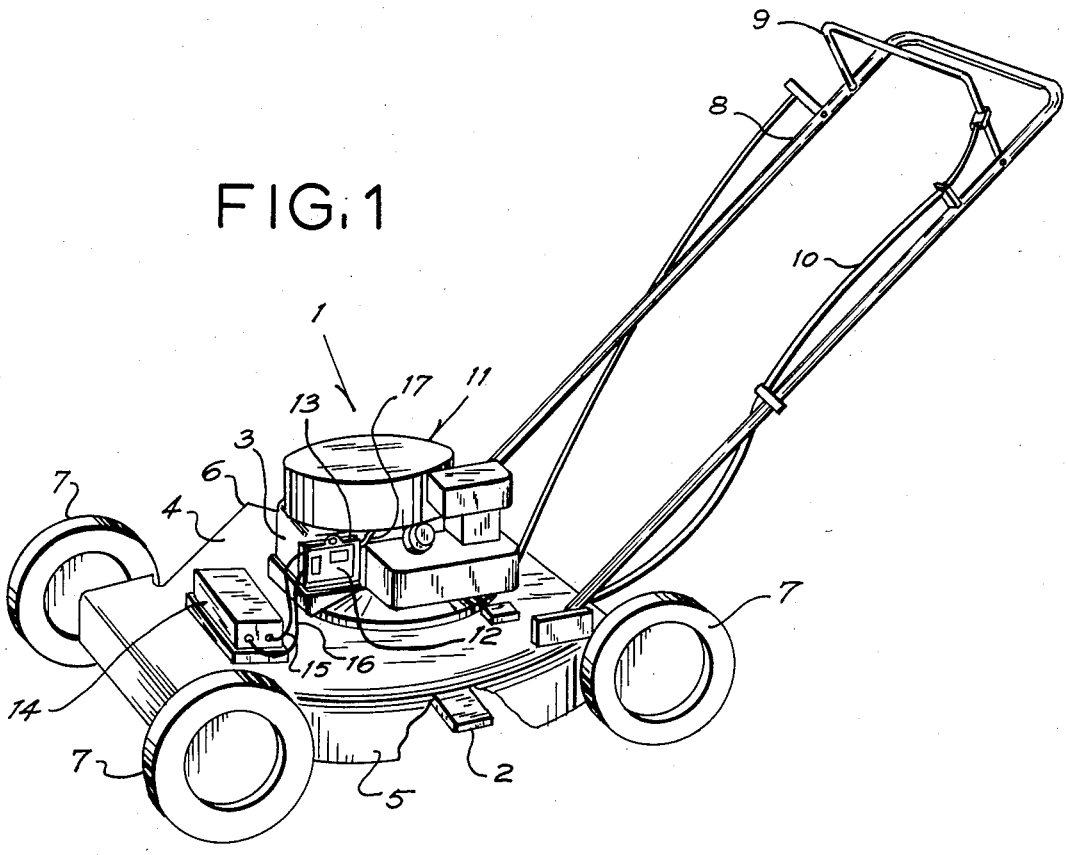
FIG. 1 is a side view in elevation of a lawn mower incorporating an electronically commutated coaxial starter motor constructed in accordance with the principals of the present invention.

Referring now to the drawings, FIG. 1 illustrates a rotary walk-behind power lawn mower generally designated by the numeral 1 incorporating an electronically commutated coaxial starter motor constructed in accordance with the present invention. Lawn mower 1 has a horizontally extending cutting blade 2 that rotates about a vertical axis that is driven by means of an internal combustion engine 3. Engine 3 is mounted on top of a deck 4 that overlies blade 2, and engine 3 is positioned so that its crankshaft (not shown) is orientated vertically and projects down through deck 4 to be drivingly connected with blade 2. A skirt 5 projects down from deck 4 to a level below the cutting height of blade 2 and completely surrounds blade 2 except at a clipping outlet 6 at one side of mower 1. Deck 1 is mounted on wheels 7, and a handle 8 that projects upwardly and rearwardly from deck 4 is held by an operator for guiding mower 1.

Mounted on handle 8 of mower 1 is a deadman control lever or bale 9. Bale 9 is shown as a U-shaped member that is biased to a released position in which it projects upwardly from the mower handle 8. For mowing, the operator swings the U-shaped bale or lever 9 down to an operating position in which it closely overlies handle 8. The deadman control lever 9 is connected through a cable 10 with a combined clutch and brake mechanism (not shown) or the like whereby blade 2 is drivingly coupled to engine 3 as long as lever 9 is held in its operating position overlying handle 8, but is declutched from engine 3 and braked to stop upon release of lever 9. Several mechanisms are known by which declutching and braking of a mower blade can be effected as a result of releasing a deadman control element, and therefore details of such a safety mechanism are not disclosed.

The electronically commutated coaxial starter motor, designated generally by the numeral 11 in FIG. 1, is controlled by electronic circuitry mounted on a circuitboard 12 affixed to a mounting bracket 13 which in turn is bolted or otherwise attached to the engine crankcase 3. The electronics contained on board 12 is powered by a battery 14 mounted on deck 4 by means of positive and negative cables 15 and 16 respectively. The electronics in turn are connected to the field windings of starter motor 11 by wires 17.

Figure 2:
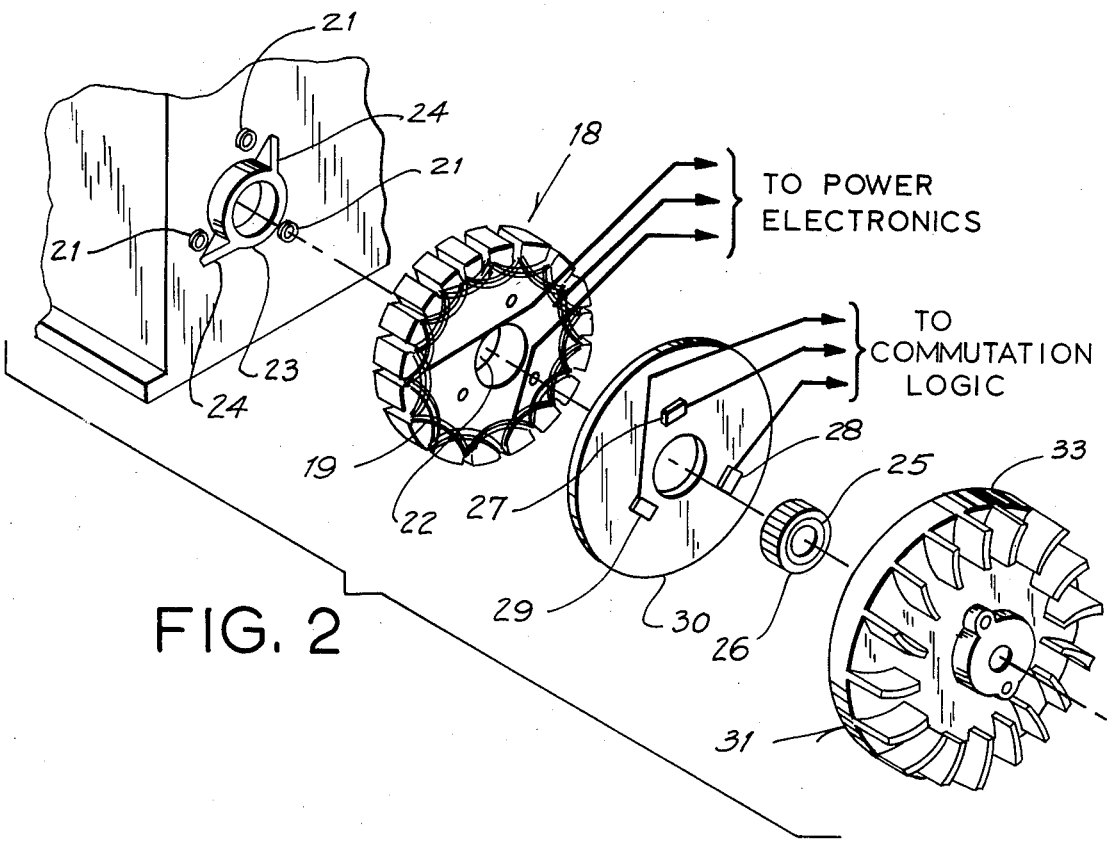
FIG. 2 is an exploded perspective view illustrating the components of the starter motor.

Referring now to FIG. 2, there is illustrated in exploded form the components of starter motor 11. Starter motor 11 includes a stator 18 composed of a ferromagnetic core material having a plurality of current carrying field windings 19 connected in a multi-phase configuration wound thereon. Stator 18 is affixed to engine cylinder 20 by means of bolts engaging mounting bosses 21 on cylinder 20. Stator 18 includes central opening 22 and a pair of radially extending slots (not shown) which further prevent rotation of stator 18 by receiving respectively in keyed relation an annular sleeve 23 and radial braces 24 that project from cylinder 20.

A shaft position indicating means is carried on the crankshaft (not shown), and thus is coaxially mounted to rotate with the crankshaft. As shown, the indicating means includes a non-magnetic annular spacer 25 affixed to the crankshaft and a ring member or magnet 26 surrounding the spacer 25. Ring magnet 26 is composed of a plurality of circumferentially arranged permanent magnets having alternate north-south poles. Spacer 25 may be keyed to the crankshaft for rotation therewith or may be affixed to the crankshaft in any conventional manner.

Stationary sensing means is also provided to sense the angular position of the indicating means and generate electrical signals in response thereto. The sensing means, described herein but not limited hereto, comprises three magnetically actuated Hall effect devices 27–29 circumferentially spaced from each other and disposed radially about the axis of rotation of the crankshaft. As is conventional, the Hall effect devices 27–29 are actuated by magnetic flux from alternate ones of the poles of the ring magnet 26 as ring magnet 26 rotates with the crankshaft. Devices 27–29 are mounted on a disc member 30 which in turn is affixed to stator 18 in any desired manner. The Hall effect devices 27–29 are located close enough to ring magnet 26 to be actuated by the fields of the north-south poles thereof, and depending upon the arrangement of the circuit to which devices 27–29 are connected, these devices 27–29 operate in response to magnetic fields of only one polarity. For example, the devices 27–29 may "turn on" due to flux from the north poles and "turn off" when influenced by the south poles of ring magnet 26. Devices 27–29 are mounted so as to be displaced far enough from the stator windings 19, and are isolated therefrom by the non-magnetic disc member 30, to prevent any interaction from magnetic fields produced by these coils, or by the permanent magnets within the flywheel as will hereinafter be described.

Figure 3:
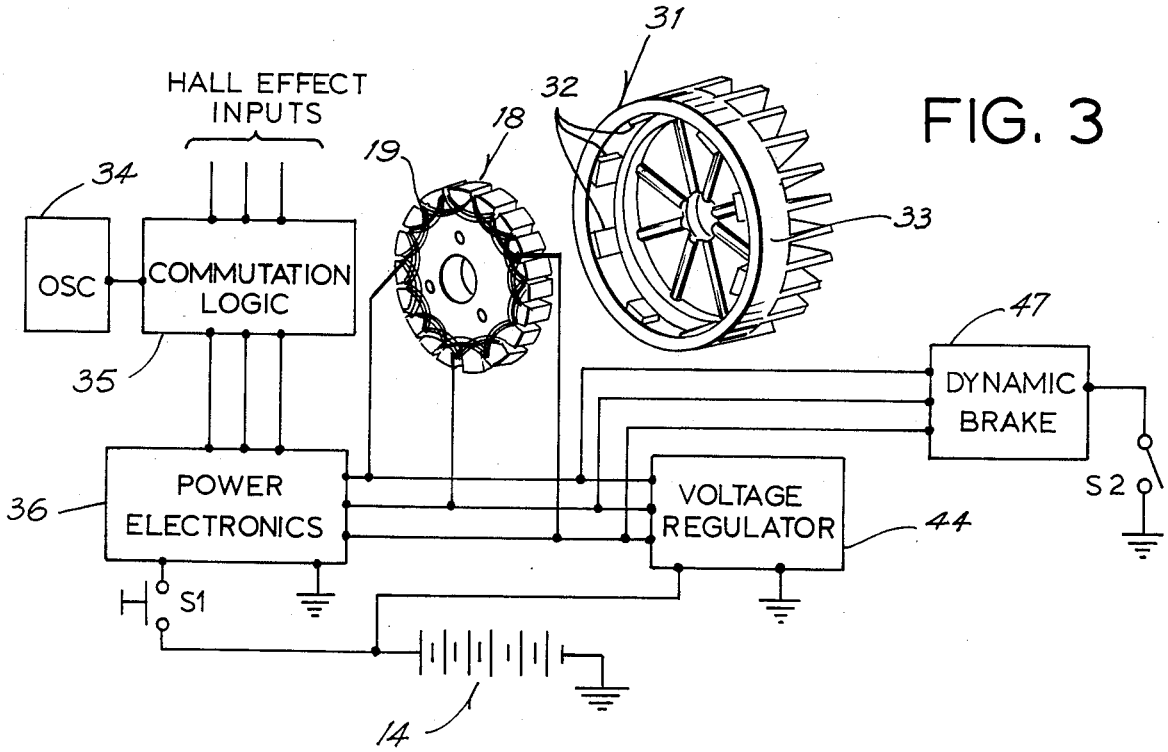
FIG. 3 is a schematic block diagram illustrating the electronic circuitry for the starter motor.

A flywheel 31 is coaxially mounted with ring magnet 26 to rotate with the crankshaft, and as best shown in FIG. 3, flywheel 31 includes a plurality of circumferentially spaced permanent magnets 32 disposed along the inner surface of its skirt portion 33. The permanent magnets 32 are mounted such that adjacent magnetic poles have opposite magnetic polarity. When assembled, the skirt portion of flywheel 31 overlaps stator 18 in the conventional manner. Thus, flywheel 31 forms a permanent magnet rotor for the starter motor 11. It should further be noted that if the flywheel is composed of cast iron, magnets 32 may be mounted directly against the interior of skirt portion 33. However, if flywheel 31 is composed of a non-magnetic material then magnets 32 would preferably be mounted along the inner diameter of an annular steel ring whose outer diameter engages the inner surface of skirt 33.

Referring now to FIG. 3, there is shown a schematic block diagram illustrating the electronic circuitry for starter motor 11. The circuitry includes a fixed or variable frequency oscillator 34 supplying a sawtooth waveform to a commutation logic device 35. The oscillator 34 determines the switching frequency of field windings 19 and in conjunction with a second voltage level (V trip) provides duty cycle modulation thereby controlling the speed of starter motor 11. The commutation logic circuit 35 preferably comprises a monolithic, ion implanted mos integrated circuit such as that available under model No. LSI7261 from LSI Computer Systems, Inc. of Melville, N.Y. It is obvious to those skilled in the art that a micro-processor based system can be programmed to function as logic device 35. Circuit 35 thus receives the electrical signals generated by Hall effect devices 27–29 as well as the output from oscillator 34, decodes it and provides logic input to the power electronics circuitry 36. The commutation logic integrated circuit device 35 includes a series of "NAND", "XNOR", "XOR", "NOR" gates and "Inverters" which accept inputs from Hall effect devices 27–29 as well as other input signals hereinafter to be described to decode them in accordance with the following truth table, as an example:

| | | | OUTPUTS ENABLED | |
|---|---|---|---|---|
| HE27 | HE28 | HE29 | FORWARD ROTATION | REVERSE ROTATION |
| 0 | 0 | 1 | 1,5 | 2,4 |
| 1 | 0 | 1 | 3,5 | 2,6 |
| 1 | 0 | 0 | 3,4 | 1,6 |
| 1 | 1 | 0 | 2,4 | 1,5 |
| 0 | 1 | 0 | 2,6 | 3,5 |
| 0 | 1 | 1 | 1,6 | 3,4 |

NOTE:
0 = OFF
1 = ON
HE = HALL EFFECT DEVICE

Other inputs to the solid state commutator logic circuit device 35 include an enable input, a braking input, electrical separation inputs, direction of rotation input, current limit input, external oscillator input and a speed input, as is commonly known in the art.

The power electronic circuit 36 includes six mosfets, i.e. metal oxide silicon field effect transistors 37–42. For example, the desirable use of "n" channel mosfets. Based on todays technology, for both upper and lower rails results in the requirement of a gate drive voltage that exceeds 20 volts for the top rail mosfets accomplished by charge pump 43. As shown best in FIG. 4, 20 volt zener diodes 50–52 are included to protect mosfets 37–39, respectively, on the top rail only. Incorporating voltage regulator 44, which controls the battery charge rate, enables the circuitry of FIGS. 3 and 4 to charge battery 14 during use. Thus, a starter motor/alternator combination is provided using the same ferromagnetic stator core 18, windings 19, rotor magnets 32, voltage regulator 44 and the incipient diodes, 53–58 (source to drain) contained therein in the power mosfets 37–46.

Figure 4:
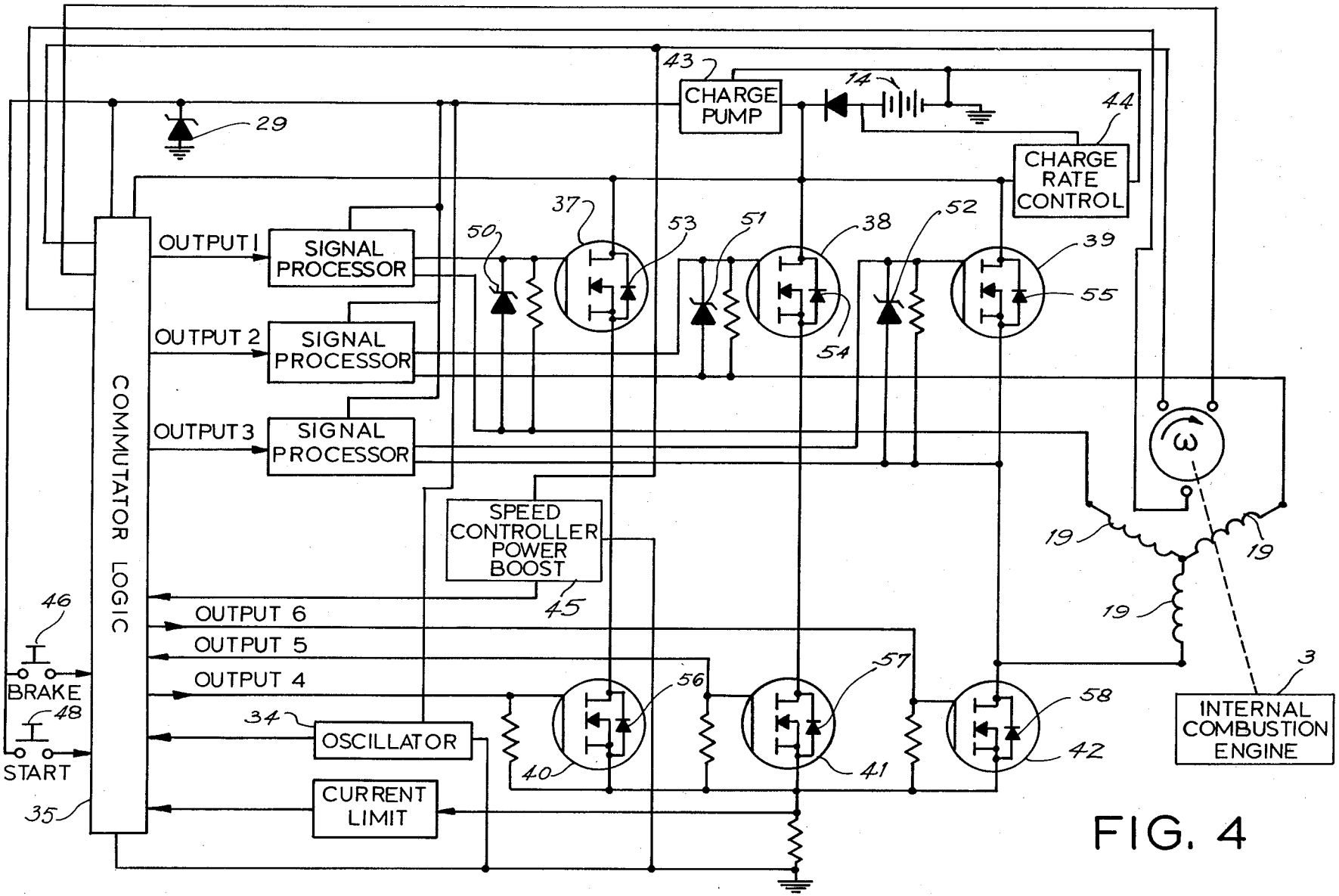
FIG. 4 is an electrical schematic diagram showing a commutating control circuit for the starter motor of FIG. 1.

As shown best in FIG. 4, a second voltage (V trip) is available in conjunction with the sawtooth oscillator to an input of commutator device 35 to create a parallel hybrid with the engine to improve the high end torque performance of engine 3. This second voltage level is available through the speed controller 45 comprising a switch located for operator convenience to thus provide a "burst of power" or "power boost" for engine 3.

Another switch 46 is connected to the brake input of logic device 35 which when actuated, causes either the top or bottom rail power mosfets 37–42 to turn on thereby short circuiting the motor windings 19 to dynamically brake engine 3 for safety purposes in lawn and garden or construction applications. This circuitry is collectively illustrated in FIG. 3 as 47. As shown best in FIG. 4, a start switch 48 is connected to the enable input of logic device 35, and is also located for operator convenience. Actuation of switch 48 causes logic device 35 and power electronics 36 to energize the proper windings 19 and the appropriate sequence on stator 18 to create sufficient torque to start flywheel 31 turning. As shown in FIG. 4, logic device 35 may be powered by the boost voltage supply of about 28 volts d.c. due to the Zener diode 49.

Figure 5:
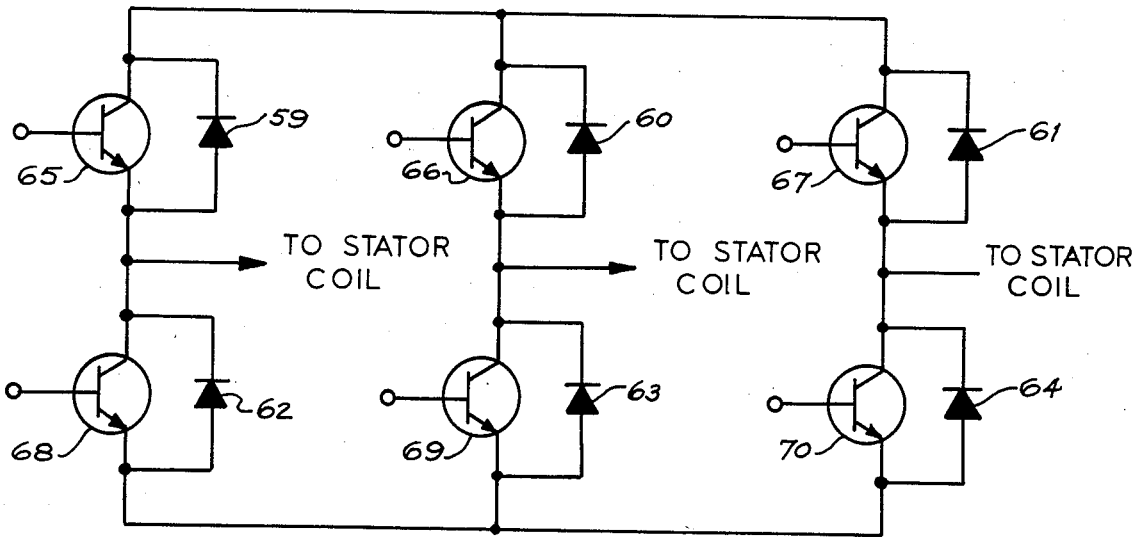
FIG. 5 is an electrical schematic diagram showing a second embodiment of the power electronic circuit portion of the commutating control circuit for the starter motor of FIG. 1.

It should be noted that if power switching devices other than mosfets are used in the circuitry, such as darlington configured bi-polar transistors etc., the alternator output is converted to direct current through external diodes, typically called "flyback" diodes, that are connected in reverse polarity and in parallel with each of the power switches in the circuit. Such flyback diodes are illustrated in FIG. 5, as 59–64 for bipolar transistors (or other suitable power switching devices) for 65–70 respectively.

The present invention thus provides a combination electric starter motor, alternator, and brake for an internal combustion and/or diesel engine that eliminates the conventional gearing, separate alternator and brake. The addition of a solid state microprocessor commutator as device 35 enables the system to provide electronic speed governing, fuel injection control, direct fire ignition, a parallel hybrid to improve highend torque of the engine, to provide for spark adjust control, and power for electric fuel and oil pumps.

Various modes of carrying out the invention are contemplated as being within the scope of the following claims particularly pointing out and distinctly claiming the subject matter which is regarded as the invention.

I claim:

1. In an internal combustion engine having a cylinder and a crankshaft defining an axis of rotation, the improvement of an electronically commutated coaxial starter motor comprising:

a stator mounted on the cylinder coaxially with the crankshaft;

angularly spaced field windings surrounding said stator;

position indicating means coaxially mounted to rotate with the crankshaft;

stationary sensing means mounted to sense the angular position of said position indicating means and generate electrical signals in response thereto;

a rotatable member coaxially mounted to rotate with the crankshaft, said rotatable member including a plurality of circumferentially spaced permanent magnets mounted thereon; and circuit means responsive to the electrical signals from said sensing means for controlling current flow through said field windings to cause said rotatable member to rotate, said electronic circuitry includes power switching devices each device having a diode connected in reverse polarity and in parallel with its respective power switching device in the circuit for converting alternator output to direct current.

2. The motor of claim 1 wherein said position indicating means comprises a ring member including a plurality of circumferentially arranged permanent magnets having alternating north-south poles.

3. The motor of claim 2 wherein said ring member surrounds a non-magnetic spacer affixed to the crankshaft and projecting axially from the cylinder.

4. The motor of claim 1 wherein said sensing means comprises a plurality of magnetically actuated Hall effect devices.

5. The motor of claim 4 wherein the number of Hall effect devices equals the number of stator phases.

6. The motor of claim 1, wherein said electronic circuitry includes power mosfets having incipient diodes contained therein for automatically converting the motor into an alternator after the internal combustion engine has started.

7. The motor of claim 1, wherein said electronic circuitry includes switching means for shorting the field windings together to dynamically brake the engine.

8. The motor of claim 1, wherein said rotatable member comprises an engine flywheel.

9. In an internal combustion engine having a cylinder and a crankshaft defining an axis of rotation, the improvement of an electrically commutated coaxial starter motor comprising:

a stator mounted on the cylinder coaxially with the crankshaft;

angularly spaced field windings surrounding said stator;

position indicating means coaxially mounted to rotate with the crankshaft, said indicating means including a non-magnetic annular spacer affixed to the crankshaft and a ring member surrounding said spacer composed of a plurality of circumferentially arranged permanent magnets having alternating north-south poles;

stationary sensing means mounted to sense the angular position of said indicating means and generate electrical signals in response thereto, said sensing means comprising a plurality of magnetically actuated Hall effect devices spaced from each other and disposed radially about the axis of rotation to be actuated by magnetic flux from altrnate ones of the poles of said ring member, said Hall effect devices being mounted on a disc member affixed to said stator;

a rotatable member coaxially mounted to rotate with the crankshaft, said rotatable member including a plurality of circumferentially spaced permanent magnetics mounted thereon; and circuit means responsive to the electrical signals from said Hall effect devices for controlling current flow through said field windings to cause said rotatable member to rotate, said electronic circuitry includes power switching devices each device having a diode connected in reverse polarity and in parallel with its respective power switching device in the circuit for converting alternator output to direct current.

10. The motor of claim 9 wherein said disc member is located between said stator and said rotatable member.

11. The motor of claim 9 wherein the number of Hall effect devices is equal to the number of stator phases.

12. The motor of claim 9, wherein said electronic circuitry includes power mosfets having incipient diodes contained therein for automatically converting the motor into an alternator after the internal combustion engine has started.

13. The motor of claim 9, wherein said electronic circuitry includes switching means for shorting the field windings together to dynamically brake the engine.

14. The motor of claim 9, wherein said rotatable member comprises an engine flywheel.

* * * * *